United States Patent [19]

Walkhoff

[11] Patent Number: 4,864,744

[45] Date of Patent: Sep. 12, 1989

[54] SKI BOOT

[75] Inventor: Klaus Walkhoff, Kreuzlingen, Switzerland

[73] Assignee: Raichle Sportschuh AG, Kreuzlingen, Switzerland

[21] Appl. No.: 293,319

[22] Filed: Jan. 4, 1989

Related U.S. Application Data

[62] Division of Ser. No. 182,997, Apr. 19, 1988.

[30] Foreign Application Priority Data

Apr. 22, 1987 [CH] Switzerland ..... 01545/37

[51] Int. Cl.[4] ..... A43B 5/04

[52] U.S. Cl. ..... 36/120; 36/51; 36/121

[58] Field of Search ..... 36/117–121, 36/54, 28, 29, 51

[56] References Cited

U.S. PATENT DOCUMENTS

| | | | |
|---|---|---|---|
| 3,738,025 | 6/1973 | Hanson et al. | 36/117 |
| 3,807,060 | 4/1974 | Hanson et al. | 36/118 |
| 3,832,792 | 9/1974 | Kastinger | 36/117 |
| 3,988,842 | 11/1976 | Rathmell | 36/121 |
| 4,043,059 | 8/1977 | Rathmell | 36/121 |
| 4,235,026 | 11/1980 | Plagenhoef | 36/28 X |
| 4,430,810 | 2/1984 | Bente | 36/121 X |
| 4,507,879 | 4/1985 | Dassler | 36/28 X |
| 4,620,380 | 11/1986 | Andinio | 36/121 |

FOREIGN PATENT DOCUMENTS

| | | | |
|---|---|---|---|
| 0155495 | 11/1985 | European Pat. Off. . | |
| 0233328 | 8/1987 | European Pat. Off. | 36/117 |
| 3336063 | 4/1984 | Fed. Rep. of Germany | 36/117 |
| 457022 | 5/1950 | Italy | 36/29 |

*Primary Examiner*—James Kee Chi

*Attorney, Agent, or Firm*—Collard, Roe & Galgano

[57] ABSTRACT

There is provided a ski boot formed of plastic material and having a sole and a shaft consisting of a front shaft part having a shell and a rear shaft part articulated on the shell at the heel. The front shaft part is provided with zones of weakness in the arch and shin areas which increase the flexibility of the front shaft part in the longitudinal direction of the boot. Stiffening elements are provided in the zones of weakness extending transversely to the boot axis and having a variable effect on the flexibility of the front shaft part of the boot. The zones of weakness are formed by wave-like elevations and depressions on the front shaft part, the elevations projecting against the outer side of the boot so as to defined hollow spaces sealed against the front side of the boot and accommodating therein the stiffening elements.

10 Claims, 6 Drawing Sheets

SKI BOOT

This is a divisional application of U.S. Ser. No. 182,997, filed April 19, 1988, entitled "Ski Boot".

The present invention relates to a ski boot formed of plastic and which has zones of weakness in the arch and shin areas so as to increase the longitudinal flexibility of the boot shaft. More particularly, the present invention relates to such a ski boot which includes adjustable stiffening elements arranged in the zones of weakness so as to adjust the flexibility of the boot shaft.

A ski boot of the above described type is known, for example from U.S. Pat. No. 3,807,060, to Hanson et al., granted April 30, 1974. The shaft of the ski boot according to this patent consists of a shell on which a narrow stiffening rib is molded, which substantially projects from the shell and extends on the top side of the boot from the tip thereof to the top of the shaft. Several cross ribs are molded on this stiffening rib with spacings between one another and which partially extend around the shell, with their height of projection beyond the shell decreasing as the distance from the stiffening rib increases. In the center between each two such cross ribs, the stiffening rib is slotted up to the shell to locally reduce the flexural stiffness of the stiffening rib and permit forward yielding of the ski boot under the pressure of the wearer's shin. Stiffening elements having a squared bridge are rotatably supported in these slots. When the bridge is aligned so that the large surfaces of the squared bridge is capable of yielding forwardly until the segments of the stiffening rib, which are separated by the respective slot, abut one another. When the stiffening elements are turned by 90° from this position, they prevent movement of the segments of the stiffening rib against one another. At the rear part of the boot, provision is made for a corresponding arrangement for adjusting the flexural stiffness under rearward bending stress.

The manufacture of such a ski boot with a longitudinally extending stiffening rib and cross ribs arranged transversely relative to the former is complex and therefore expensive. Furthermore, the danger of icing is encountered particularly in wet snow because the slots are outwardly open, particularly towards the front of the boot, and considerably exposed, so that snow and ice may penetrate the slots. The load changes constantly occurring during skiing cause compression of the entrapped snow, resulting in a reduction in the desired flexibility.

It is, therefore, an object of the present invention to provide a ski boot that can be manufactured simply and easily and wherein the adjustable flexural stiffness remains substantially constant over a long period of use and under varied snow conditions.

The above object is accomplished in accordance with the present invention by the provision of a ski boot formed of plastic material and having a sole and a shaft consisting of a front shaft part having a shell and a rear shaft part articulated on the shell at the heel. The front shaft part is provided with zones of weakness in the arch and shin areas which increase the flexibility of the front shaft part in the longitudinal direction of the boot. Stiffening elements are provided in the zones of weakness extending transversely to the boot axis and having a variable effect on the flexibility of the front shaft part of the boot. The zones of weakness are formed by wave-like elevations and depressions on the front shaft part, the elevations projecting against the outer side of the boot so as to define hollw spaces sealed against the front side of the boot and accommodating therein the stiffening elements.

The shaft of the ski boot of the present invention can be manufactured very simply if the regions or zones of weakness are formed by wave-like swells and depressions at the front part of the shaft. If the swells or elevations projecting against the outer side of the boot form hollow spaces closed or sealed at least against the front side of the boot, with such hollow spaces accommodating the stiffening elements, it is very difficult for snow to penetrate such hollow spaces from the outside.

In a preferred embodiment of the invention, the front part of the shaft is equipped with a tongue covering the shell in the arch and shin areas, the tongue being fastened on the shell. In this case, the regions of weakness are formed within the tongue, which permits a very simple manufacture of the front part of the shaft and a separate manufacture of the tongue.

Preferably, the stiffening elements are rotatably supported about an axis of the cylindrically shaped hollow spaces, and exhibit different compression behavior depending on their positioning relative to their axis of rotation. In this way, it is possible to increase or reduce the flexibility of the front part of the shaft by simply turning the stiffening elements. Each stiffening element may consist of a stiffening bridge designed to pivot around its axis of rotation, have a rectangular cross section and be made from a material with low elasticity. Face walls may be formed or molded on such a bridge on its face side, thereby sealing the hollow spaces laterally against the outer side of the boot and maintaining the adjusted flexibility constant with particularly good results. Preferably, a handle is molded on at least one of the face walls of the stiffening bridge, so that the position of the stiffening elements can be adjusted from the outside of the boot in a very simple manner.

A stepless adjustment of boot flexibility with particular ease of setting is accomplished by means of an arrangement in which all the stiffening elements are jointly adjusted by a driving arrangement in the interior of the boot.

Another type of stepless adjustability of boot flexibility, can be accomplished wherein the stiffening elements are designed as elastic, airtight balloon elements, which operatively communicate with one another and with a pump. The pump is advantageously equipped with a check and venting valve and is arranged on or within the ski boot.

In another preferred embodiment of the invention, the stiffening elements are slidably mounted on a threaded spindle, which is rotatably supported on an abutment and rotatable by means of a rotary handle. Stepless adjustment of the flexibility of the boot, is possible with this embodiment as well.

In another embodiment of the ski boot according to the present invention, the zones of weakness are formed by an elastic element supported on a part of the shell covering the front part of the foot. At least two hollow spaces sealed against the front side of the boot are arranged in the elastic element and accommodate the stiffening elements. The elastic element is joined with an adjusting mechanism fastened on the shell part, whereas the front part of the shaft is supported at the other end of the elastic element which is disposed opposite the adjusting mechanism. This permits adjustment also of the zero position of the front part of the shaft, in addition to adjustment of foot flexibility.

Other objects and features of the present invention will become apparent from the following detained description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
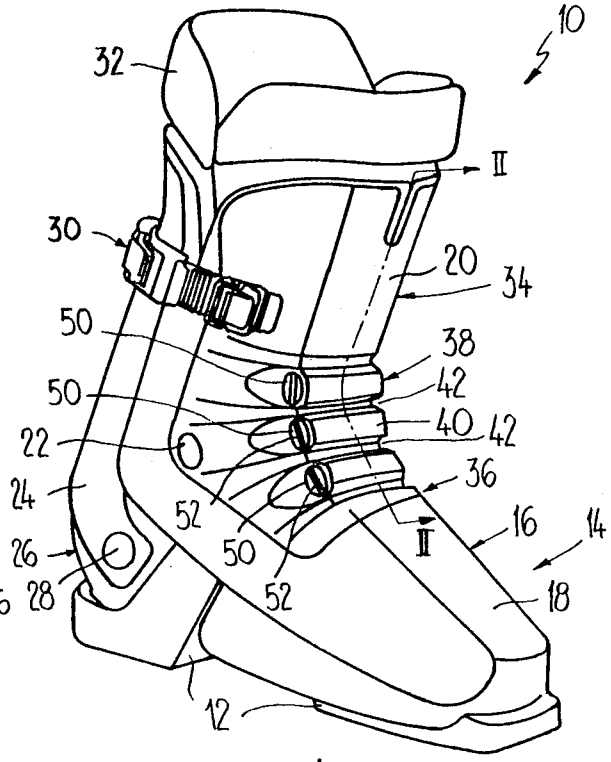
FIG. 1 is a perspective view of a first embodiment of the ski boot with adjustable flexural stiffness according to the present invention.

Now turning to the drawings, there is shown in FIG. 1 a ski boot 10 molded from a plastic material and which is comprised of a sole 12 and a shaft 14. A front shaft part 16 is formed by a shell 18 and a tongue 20 covering shell 18 in the arch and shin areas. Tongue 20 is connected with shell 18 at connection points 22, which are arranged opposite one another with respect to the longitudinal axis of the boot. Shaft 14, furthermore, comprises a rear shaft part 24, sometimes called a spoiler, fastened within heel zone 26 by means of two oppositely arranged joints 28, which permit swivelling on shell 18. Rear shaft part 24 may be connected with tongue 20 by suitable means, such as locking device 30. Also, shaft 14 encloses a cushioned inner boot 32. Buckle or locking device 30 and inner boot 32 are well known prior art elements.

Within the zone or region of transition from shin area 34 to arch area 36, tongue 20 is provided with the regions or zones of weakness 38, which are formed by wave-like elevations 40 followed by depressions 42. Zones of weakness 38 provide tongue 20 and thus front shaft part 16 with increased flexibility when tongue 20 is stressed or pressed forwardly in the direction of the tip of the boot. Elevations 40 projecting toward the outer side of the boot define hollow spaces 44 (see FIGS. 2 to 4), which are sealed against the front side of the boot. In the embodiment shown, said hollow spaces 44 are also sealed against the inside of the boot, as shown in particular in FIGS. 2 to 4. However, conceivably, hollow spaces 44 may be designed to be opened towards the inside of the boot. Hollow spaces 44 extend in a transverse direction relative to the longitudinal axis of the boot.

Figure 2:
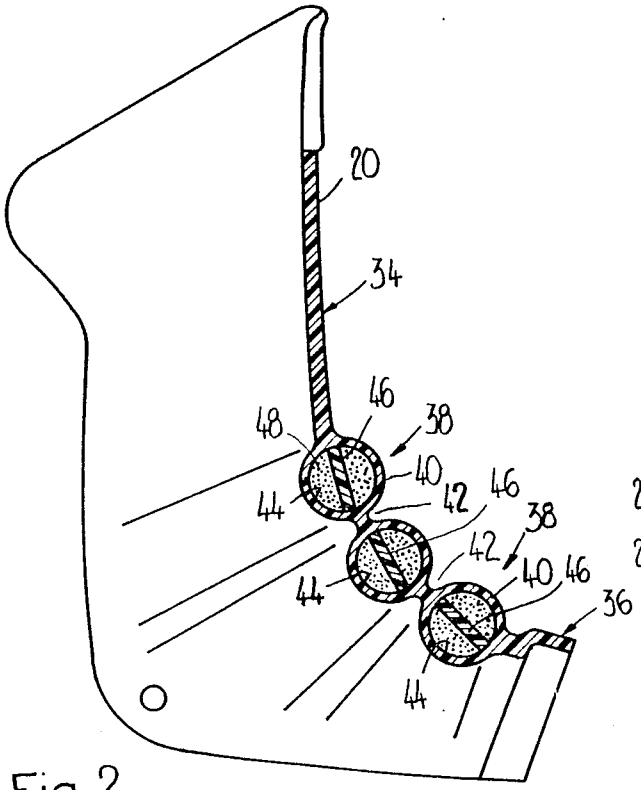
FIGS. 2 to 4 are longitudinal cross-sectional views taken along line II—II through the tongue of the ski boot of FIG. 1, with three different adjustments or settings of the rotatable stiffening elements.
Figure 3:
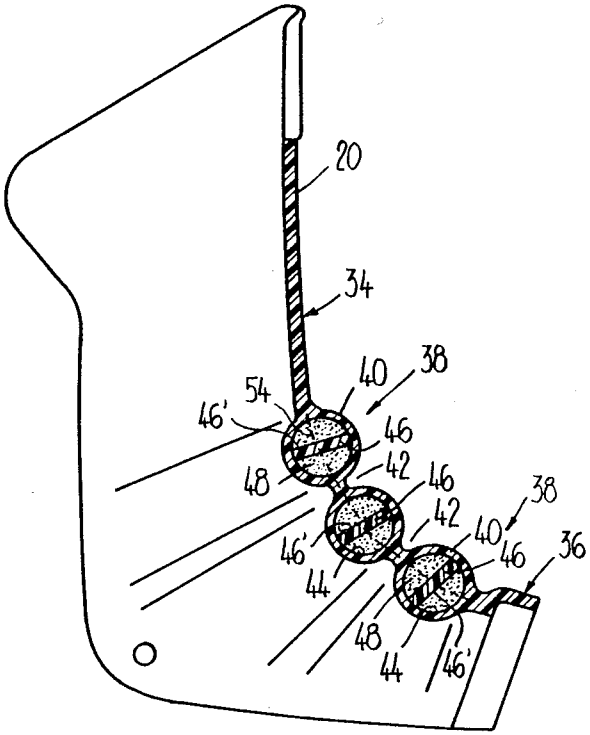
Figure 4:
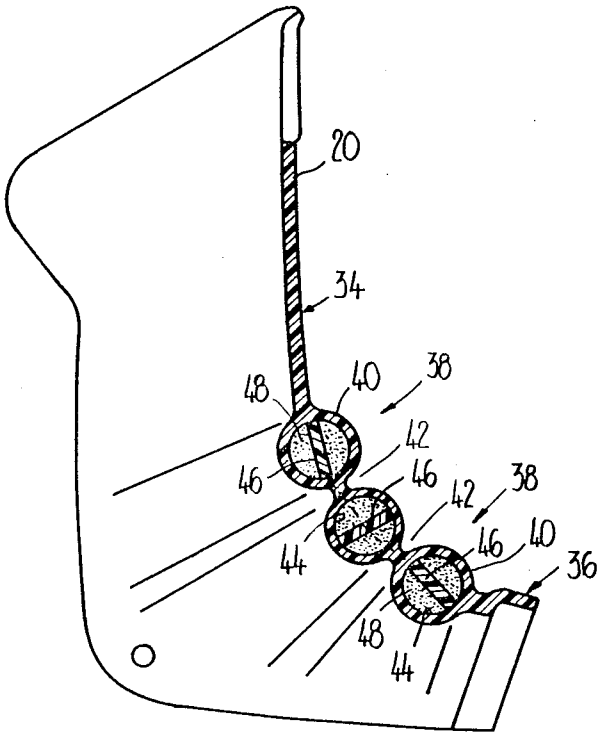

The interior of hollow spaces 44 accommodate squared stiffening elements 46, which are rotatably supported about the longitudinal axis of hollow spaces 44 (FIGS. 2 to 4). Stiffening elements 46, which have a bridge-like shape, are made from a material with low compressibility, preferably from a suitable plastic material. The regions of hollow spaces 44 between stiffening bridges 46 and the inside wall of hollow spaces 44 are filled with a material 48 having a higher compressibility than the material forming stiffening bridges 46, such as a foam material. On the face sides of stiffening bridges 46, face walls 50 (FIG. 1) are shaped by molding to laterally seal hollow spaces 44 against the outer side of the boot. Slots 52 are formed in face walls 50 so that by using an object that engages slots 52, for example a coin, stiffening bridges 46 can be turned as explained in greater detail hereinafter by reference to FIGS. 2 to 4. Instead of slots, of course, other types of manipulation means can be used, for example ribs outwardly projecting from face walls 50, which ribs can be seized or gripped by hand.

If all the stiffening bridges are turned into the position shown in FIG. 3, in which position all stiffening bridges 46 extend with their broad side 46' transversely relative to an imaginary line 54 extending between shin area 34 and arch area 36 of tongue 20, the stiffening effect of stiffening bridges 46 is non-existent or very nearly non-existent. This means that when tongue 20 is flexurally stressed in the forward direction, the regions of weakness 38 are capable of developing their full effect, providing tongue 20 with relatively high flexibility.

If, in contrast to the above, stiffening bridges 46 are turned from their above-described position by 90°, in which case stiffening bridges 46 extend in the direction of the above-mentioned imaginary connecting line 54 (FIG. 2), the stiffening effect is fully developed. This means that the regions of weakness 38 and thus tongue part 20 are stiffened, so that the latter, when flexurally stressed, is less easily deflected towards the tip of the boot.

Of course, individual stiffening bridges 46 may be turned into different positions as shown in FIG. 4. In this way, it is possible to adjust intermediate values within the range of maximum (FIG. 3) and minimum flexibility (FIG. 2).

In order to prevent the stiffening bridges from being inadvertently turned, provision is made for locking means (not shown in the figures) for arresting stiffening bridges 46 both in the position shown in FIG. 2 and the position shown in FIG. 3 or intermediate positions.

Figure 5:
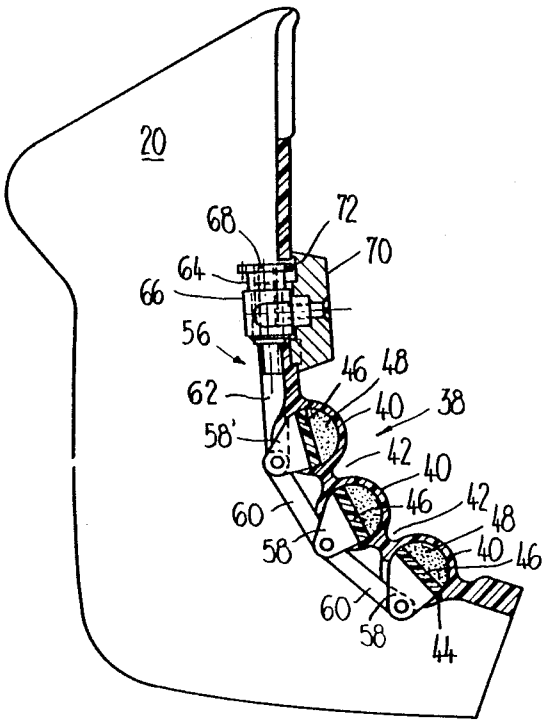
FIG. 5 is a longitudinal cross-sectional view taken along line V—V through the tongue of the ski boot embodiment of FIG. 6, with a driving arrangement for commonly adjusting all stiffening elements.
Figure 6:
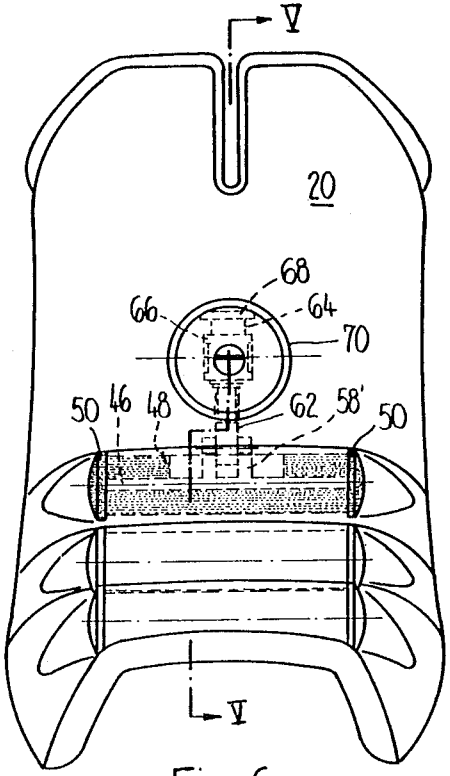
FIG. 6 is a front elevational view of the tongue shown in FIG. 5.

In the embodiment shown in FIGS. 1 to 4, each stiffening bridge 46 is individually rotatable independently from the other stiffening bridges 46, which, on the one hand, permits adjustment of different degrees of flexibility, as described above, and on the other hand requires also a certain expenditure for making such adjustment changes. FIGS. 5 and 6 show an embodiment in which stiffening bridges 46 can be jointly changed in their position. The reference numerals in FIGS. 5 and 6 correspond with those used for identical parts in FIGS. 1 to 4.

With the variation shown in FIGS. 5 and 6, an adjusting mechanism 56 for commonly adjusting all stiffening bridges 46 is arranged in the interior of the boot. A lever arm 58 projects from each stiffening bridge 46, lever arms 58 are interconnected with one another by means of two straps 60, which are articulated on lever arms 58. A threaded pin 62 is connected with the topmost lever arm 58' and engages a threaded sleeve 64, which is supported on a holding means or abutment 66 fastened on tongue 20. At its top end, threaded sleeve 64 is fitted with a toothed gear 68. A rotary button 70 is arranged on the outer side of the tongue 20, and is rotatably supported in holding means 66 and provided with a toothed rim 72 which engages toothed gear 68.

By turning rotary button 70, threaded sleeve 64 is turned, resulting in a lifting or lowering of threaded pin 62. This, in turn, effects a common turning of stiffening bridges 46 in the interior of hollow spaces 44, which permits a stepless changing of the position of stiffening bridges 46. If the latter are in the position shown in FIG. 5, which conforms to the position according to FIG. 2, the highest possible stiffening effect is achieved. In FIG. 6, the other extreme position is shown, in which stiffening elements 46 assume the same position as in FIG. 3. In the latter position, stiffening elements 46 have no or very little stiffening effect.

Figure 7:
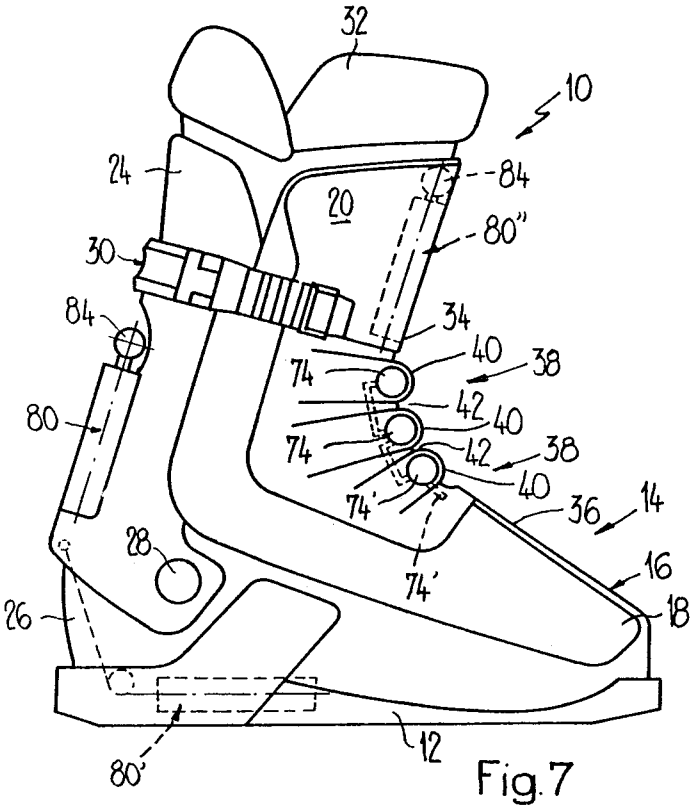
FIG. 7 is a side elevational view of another embodiment of the ski boot, with a built-in pump.
Figure 8:
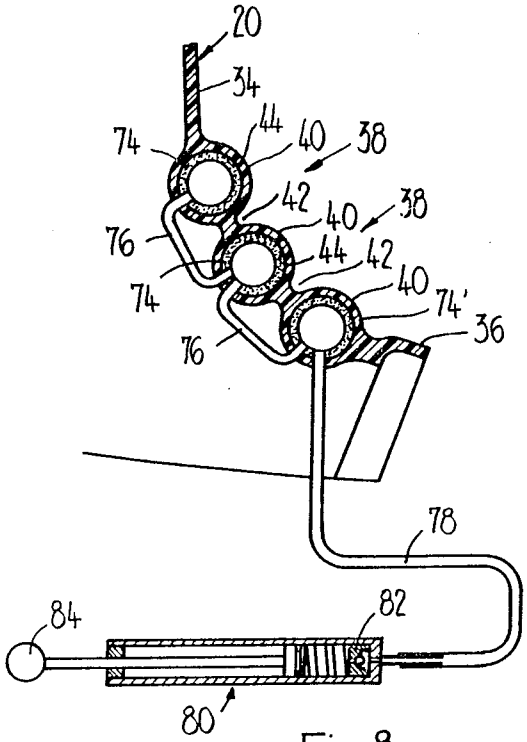
FIG. 8 is an enlarged longitudinal cross-sectional view through part of the tongue of the ski boot of FIG. 7, together with a longitudinal section through a pump.

FIGS. 7 and 8 show another variation wherein ski boot 10 has, for the most part, the same structure as the one according to FIG. 1 and thus the same reference numerals for identical parts as the boot of FIGS. 1 to 4.

The embodiment according to FIGS. 7 and 8 differs from the ski boot according to FIGS. 1 to 4 with respect to the design of the stiffening elements. In the embodiment according to FIGS. 7 and 8, the stiffening elements are formed by elastic, airtight balloon elements 74, which are communicatively connected with one another by way of the connecting lines 76, which are shown in particular in FIG. 8. Bottom balloon element 74' is connected with a schematically shown pump 80 having a check valve 82 by a connecting line 78. Pump 80, which preferably is arranged on rear shaft part 24, as clearly seen in FIG. 7, is additionally equipped with a venting valve not shown in the drawings, the venting valve being actuated from the outside of the boot. By actuating the pump tappet 84, which also can be seized or gripped from the outside of the boot, the pressure in balloon elements 74 can be raised, and thereby their stiffening effect. By opening the venting valve, the pressure in balloon elements 74 can be reduced again if higher flexibility of tongue 20 is desired.

Figure 9:
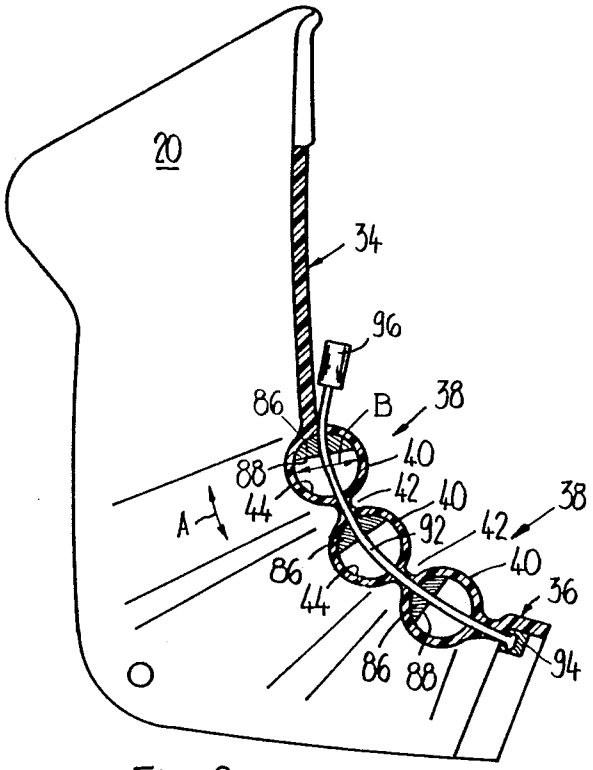
FIG. 9 is a longitudinal cross-sectional view through the tongue of another embodiment of a ski boot with displaceable stiffening elements and high flexural stiffness.
Figure 10:
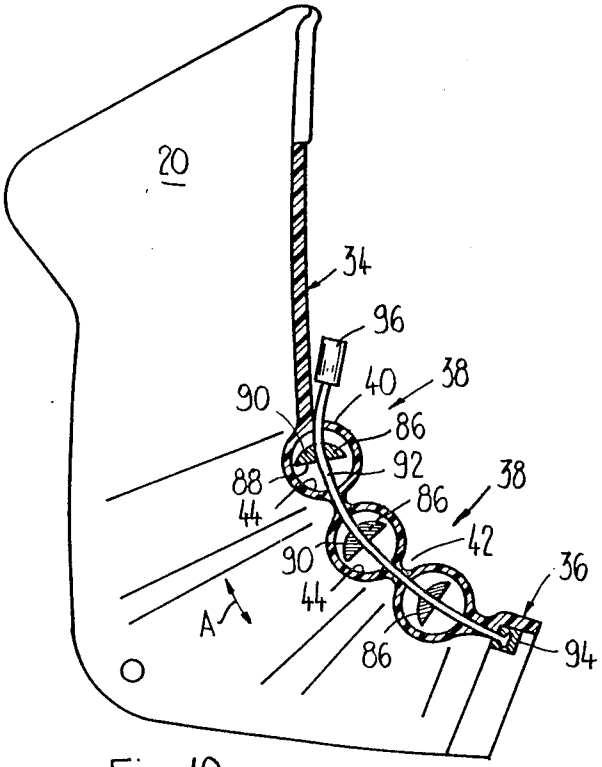
FIG. 10 is a view similar to that of FIG. 9 but with the adjustment with low flexural stiffness.

In FIGS. 9 and 10, which show a view similar to FIGS. 2 to 4, a tongue 20 is shown together with another possible embodiment of the stiffening elements. The latter, identified herein by reference numerals 86, have a circular segment-shaped cross section, where the width B (FIG. 9) of the base area 88 of stiffening elements 86 is smaller than the diameter of hollow spaces 44, in which stiffening elements 86 are accommodated. Jacket surface 90 (FIG. 10) of stiffening element 86, which surface forms part of a cylindrical jacket, has substantially the same curvature as the inside wall of hollow space 40. Stiffening elements 86 are seated on a flexible threaded bar 92, which is rotatably supported at its bottom end in an abutment 94, the latter being mounted on the inner side of tongue 20. At its other end, threaded bar 92 is fitted with a rotary handle 96. By turning threaded bar 92 with rotary handle 96, stiffening elements 86 are displaced in the direction of arrow A along threaded bar 92. If stiffening elements 86 are shifted into their end position shown in FIG. 9, they develop their highest possible stiffening effect, which means that tongue 20 has a lower flexibility. On the other hand, if stiffening elements 86 are displaced downwardly, so that they are lifted from the inner wall of intermediate spaces 44 (FIG. 10), the flexibility of tongue 20 is increased as stiffening elements 86 are capable of developing only a minor stiffening effect or no such effect at all.

Figure 11:
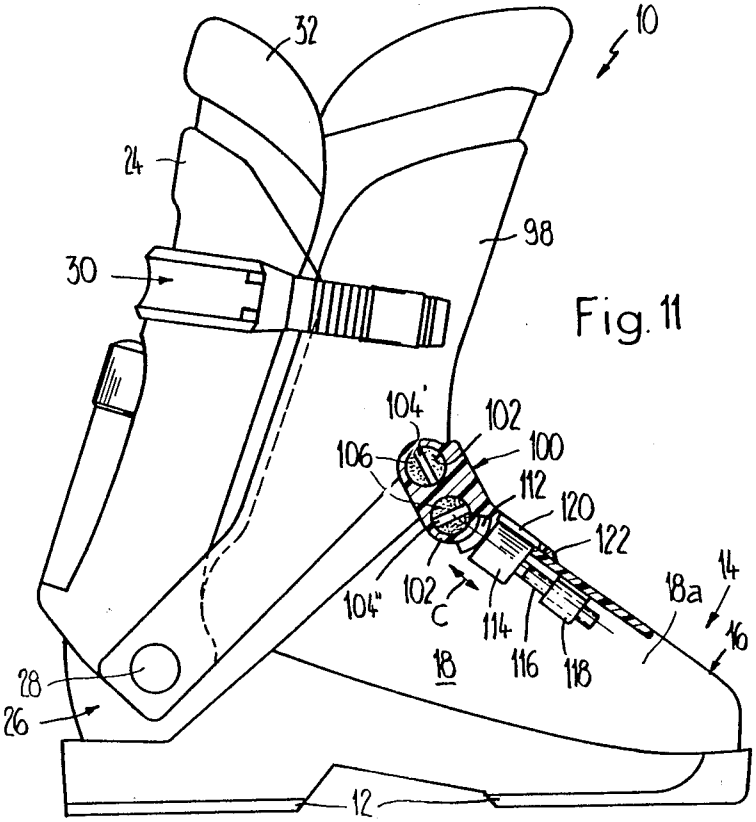
FIG. 11 is a side elevational view of an embodiment of a ski boot with a front shaft part.

The ski boot shown in FIG. 11 is slightly different frm that shown in FIG. 1. The same reference numerals are used to the extent that the ski boots according to FIGS. 1 and 11 are comprised of identical parts.

Figure 12:
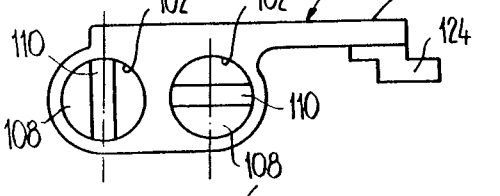
FIG. 12 is an enlarged view of an elastic element between a front shaft part and the shaft of the ski boot according to FIG. 11.
Figure 13:
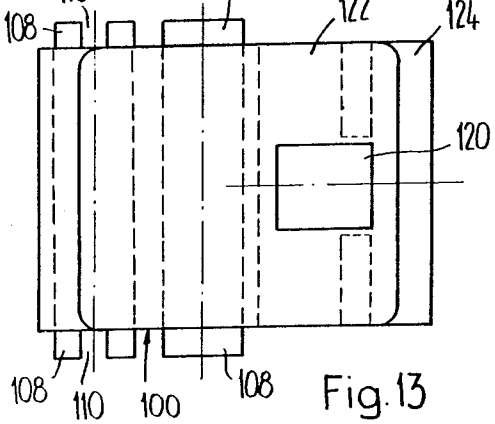
FIG. 13 is a top view of the elastic element according to FIG. 12.

In the ski boot according to FIG. 11, front shaft part 16 has a front shaft element 98 pivotally mounted on shell 18 by means of joints 28. Front shaft element 98, sometimes called the front spoiler, is supported on elastic element 100, in which at least the two hollow spaces 102 are formed, extending transversely relative to the longitudinal axis of the boot. Stiffening elements 104, which are adapted to rotate around their longitudinal axes, are arranged in hollow spaces 102. As with the stiffening elements of the embodiment according to FIGS. 1 to 4, stiffening elements 104 are designed in the form of bridges made from a relatively hard plastic material. The hollow space between stiffening bridges 104 and the inside wall of hollow spaces 102 is filled with an elastically compressible material 106, preferably a foam material, in the same way as described in connection with FIGS. 1 to 4. Face walls 108 are formed by molding onto stiffening bridges 104 (see FIGS. 12 and 13), and define hollow spaces 102 laterally. Face walls 108 have slots 110 for inserting therein a suitable object, for example a coin, by means of which stiffening bridges 104 can be rotated.

Elastic element 100 is supported on a rotary button 114 via an intermediate element 112 (FIG. 11). Rotary button 114 is rigidly connected and rotatably locked with a threaded pin 116, the latter fully penetrating nut 118 mounted on the inner side of part 18*a* of shell 18, such part covering the front portion of the foot. Elastic element 100 is fitted with a window 120 formed in an extension part 122. In addition, a guide part 124 (see FIGS. 12 and 13) is mounted on extension part 122, said guide part being guided for lengthwise displacement in shell part 18*a*. By rotating rotary button 114, it is moved in the direction indicated by arrow C, and intermediate element 112 and elastic element 100 are displaced by such rotation, with the result that the position of front shaft part 98 relative to shell 18 can be adjusted (zero point adjustment being in the unloaded condition).

By rotating stiffening bridges 104, the compression behavior of elastic element 102 can be adjusted in the direction of the tip of the boot when front shaft part 98 is stressed flexurally, in the same way as described by reference to FIGS. 2 to 4. If both stiffening bridges 104 are shifted into the position assumed by the stiffening elements 104' in FIG. 11, a maximum stiffening effect is achieved analogous to the flexibility adjustment according to FIG. 2. When stiffening elements 104 are in such a position, elastic element 100 can be compressed only to a minimum degree. On the other hand, if the two stiffening bridges 104 are turned into the position assumed by bottom stiffening bridge 104" in FIG. 11, the stiffening effect of stiffening bridges 104 is minimal, which means that elastic element 100 can be compressed to the greatest extent possible. With the intermediate position shown in FIG. 11, in which the two stiffening bridges 104' and 104'' assume positions in which they are turned against one another by 90°, elastic element 100 can be compressed with less ease.

Instead of stiffening bridges 104, it is, of course, also possible to use inflatable filling elements as explained in connection with FIGS. 7 and 8.

With the embodiment according to FIGS. 7 and 8, it is possible also to mount the pump 80 in the interior of the boot instead of on the outer side of the ski boot. For example, pump 80 can be accommodated in sole 12, or in shin area 34. These two installation possibilities are indicated in FIG. 7 by phantom lines and denoted by the reference numerals 80' and 80'', respectively. It is understood that if pump 80' or 80'' is installed in the interior of the boot, and particularly in sole 12, one should select a design or construction permitting actuation of the pump from the outer side of the boot.

In the embodiments according to FIGS. 1 to 10, the area or part with the regions of weakness 38 may be manufactured from a material having less flexural stiffness than the material used for the surrounding wall sections, in the manner described in U.S. patent application Ser. No. 06/942,898.

Instead of arranging the regions of weakness, which are formed by wave-like elevations and depressions, on a tongue that is separate from the shell, in the manner described in the foregoing, it is also possible to shape such elevations and depressions by molding on the shell itself, in the manner known, for example from the U.S. Pat. No. 4,281,468, to Giese et al., granted August 4, 1981. In that case, the stiffening elements are arranged in the areas formed by the elevations.

While several embodiments of the present invention have been shown and described, it will be obvious that many changes and modifications may be made thereunto without departing from the spirit and scope of the invention.

What is claimed is:

1. A ski boot formed of plastic material and having a sole and a shaft, the shaft consisting of a front shaft part and a rear shaft part articulated on said front shaft part in the region of the heel, said front shaft part having zones of weakness arranged in the arch and shin areas which increase the flexibility of said front shaft part in the longitudinal direction of the boot, said zones of weakness having substantially cylindrically shaped hollow spaces extending transversely relative to the longitudinal axis of the boot which are closed at least towards the front side of the boot, said stiffening elements being accommodated in each of said hollow spaces and having associated therewith adjusting means for varying the flexibility of said front shaft part, each stiffening element comprising a stiffening bridge formed of a material having low elasticity, said stiffening bridge being pivotable around its axis of rotation and having a substantially rectangular cross-section, and a material of high elasticity filling the space defined between each stiffening bridge and the inside wall of the associated hollow space being filled with a material of high elasticity.

2. A ski boot as defined in claim 1, wherein front shaft part includes a tongue covering the shell in the arch and shin area fastened on said shell, said zones of weakness being formed within said tongue.

3. The ski boot as defined in claim 1, wherein said the hollow spaces for said zones of weakness are cylindrically shaped and each stiffening element is rotatably supported around the axis thereof, and wherein said stiffening elements exhibit a different compression behavior in directions extending transversely relative to their axis of rotation.

4. The ski boot as defined in claim 3, wherein each said stiffening element comprises a stiffening bridge formed of a material with low elasticity, said stiffening bridge being pivotable around its axis of rotation and having a rectangular cross-section.

5. The ski boot as defined in claim 4, wherein the space between the stiffening bridge and the inside wall of the hollow space is filled with a material of high elasticity.

6. The ski boot as defined in claim 4, wherein said hollow spaces are sealed against the outside of the boot at least together with face walls formed on the stiffening bridges on the face sides thereof.

7. The ski boot as defined in claim 6, wherein the position of each stiffening element is adjustable from the outside of the boot by means of a manipulating means formed on one of its face walls.

8. The ski boot as defined in claim 3, wherein said stiffening elements are commonly adjustable by means of an adjusting mechanism arranged in the interior of the boot.

9. The ski boot as defined in claim 8, wherein said adjusting mechanism comprises lever arms formed on said stiffening elements, said lever arms projecting from the hollow spaces of said zones of weakness towards the interior of the boot, and the ends of said lever arms being operatively connected to each other and with an adjusting member.

10. The ski boot as defined in claim 1, wherein said front shaft part includes a shell and a front shaft element pivotably supported on said shell within the heel region and covering said shell in the shin area, and which further includes an elastic element supported on said shell in the front part of the foot, said elastic element forming said zones or weakness and having at least two hollow spaces arranged therein accommodating said stiffening elements, and an adjusting mechanism fastened on said shell and actuated from the exterior of the boot for adjusting said elastic element and said front shaft part with respect to said shell.

* * * * *

UNITED STATES PATENT AND TRADEMARK OFFICE

CERTIFICATE OF CORRECTION

PATENT NO. : 4,864,744

DATED : September 12, 1989

INVENTOR(S) : Klaus Walkhoff

It is certified that error appears in the above-identified patent and that said Letters Patent is hereby corrected as shown below:

Cover page, column 1, item [30], delete line 2 in its entirety and substitute therefor —April 22, 1987 [CH] Switzerland 01 545/87

Signed and Sealed this

Sixteenth Day of July, 1991

*Attest:*

*Attesting Officer*

HARRY F. MANBECK, JR.

*Commissioner of Patents and Trademarks*